United States Patent [19]

Bussereau et al.

[11] Patent Number: 4,823,588

[45] Date of Patent: Apr. 25, 1989

[54] HAND TOOLS INCLUDING A HYDRAULIC JACK FOR THE CONTROL OF WORKING MEMBERS

[75] Inventors: Marcel Bussereau, Vendôme; Alain Courtois; Jean-Pierre Huet, both of Blois, all of France

[73] Assignee: Societe D'Etudes Et De Methode D'Applications, Vendôme, France

[21] Appl. No.: 119,247

[22] PCT Filed: Apr. 19, 1985

[86] PCT No.: PCT/FR85/00091

§ 371 Date: Dec. 19, 1985

§ 102(e) Date: Dec. 19, 1985

[87] PCT Pub. No.: WO85/04831

PCT Pub. Date: Nov. 7, 1985

Related U.S. Application Data

[63] Continuation of Ser. No. 822,305, Dec. 19, 1985, abandoned.

[30] Foreign Application Priority Data

Apr. 20, 1984 [FR] France ..... 84 06346

[51] Int. Cl.[4] ..... B21J 9/12

[52] U.S. Cl. ..... 72/453.06; 72/453.07; 72/453.16; 60/477; 91/24; 91/25

[58] Field of Search ..... 72/453.02, 453.06, 453.07, 72/453.15, 453.16, 453.05; 60/583, 594, 477; 91/24, 25

[56] References Cited

U.S. PATENT DOCUMENTS

| | | | |
|---|---|---|---|
| 2,254,613 | 9/1941 | Matthysse | 72/453.16 |
| 2,696,850 | 12/1954 | Peterson | 72/453.16 |
| 2,729,063 | 1/1956 | Hoadley | 72/453.16 |
| 3,017,905 | 1/1962 | Klein | 72/453.16 |
| 4,055,069 | 10/1977 | Caporusso et al. | 72/453.16 |
| 4,149,381 | 4/1979 | Mekler | 60/47 |
| 4,173,171 | 11/1979 | Lange | 91/25 |
| 4,226,110 | 10/1980 | Suganuma | 72/453.16 |
| 4,235,088 | 11/1980 | Kreiskorte | 72/453.07 |
| 4,339,942 | 7/1982 | Svensson | 72/453.16 |
| 4,604,890 | 8/1986 | Martin | 72/453.16 |

FOREIGN PATENT DOCUMENTS

| | | | |
|---|---|---|---|
| 0052287 | 5/1982 | European Pat. Off. . | |
| 2344657 | 3/1975 | Fed. Rep. of Germany | 91/25 |
| 2242584 | 3/1975 | France | 91/25 |
| 0654191 | 5/1951 | United Kingdom . | |

*Primary Examiner*—David B. Jones

*Attorney, Agent, or Firm*—Sandler & Greenblum

[57] ABSTRACT

The present invention is a hydraulic hand-tool which includes an elongate piston having at least two sections of different transverse cross-sectional areas, a housing including a hollow front end portion having an interior surface defining a plurality of sections with different inner diameters corresponding in size, position and number to accommodate the sections of the piston in a manner which permits the piston to slide in a reciprocating manner within the hollow forward end of the housing and to define a main chamber and at least one auxiliary chamber for receiving hydraulic fluid as the piston slides in a forward direction; an hydraulic fluid conduit having a primary line with an end opening directly into the main chamber and at least one supplemental line communicating with at least one of the auxiliary chambers after the piston slides in a forward direction a predetermined distance; an hydraulic fluid or reservoir adapted to supply hydraulic fluid to another end of the primary line; and a pump in communication with the primary line adapted to transfer fluid from the reservoir through the primary line first into the main chamber to cause the piston to slide in a forward direction for a predetermined distance and, thereafter, through at least one supplemental line into at least one auxiliary chamber to cause the piston to continue to slide in a forward direction, thereby successively placing the main chamber into fluid communication with at least one auxiliary chamber as the piston slides in a forward direction.

19 Claims, 3 Drawing Sheets

HAND TOOLS INCLUDING A HYDRAULIC JACK FOR THE CONTROL OF WORKING MEMBERS

This application is a continuation of application Ser. No. 822,305, filed Dec. 19, 1985, now abandoned.

BACKGROUND OF THE INVENTION

1. Field of the Invention

The present invention is directed to improvements for hand-tools including an hydraulic jack mechanism to control the working members of the hand-tool.

In particular, the present invention relates to tools in which pressure must be exerted on a working member, mounted in a moveable manner in a head, by a hydraulic jack activated by a suction and discharge pump conventionally, controlled manually.

2. Discussion of Background and Material Information

Conventional hand-tools equipped with hydraulic jack mechanisms are typically pincer-type devices normally used to perform operations such as bending, cutting, boring, encasing, and the like. In such devices, the hydraulic jack serves to control the displacement of a moveable jaw, with respect to another fixed jaw, both mounted in a head. Often, these tools are transformable i.e., the jaws-carrying head is interchangeable and fixed to the end of the jack from which the shaft of the piston of the jack emerges in such a manner as to permit one to adapt the type and size of the jaws to the work. Likewise, a given head can be adapted to receive jaws of various shapes and sizes.

U.S. Pat. No. 4,149,381 is a representative example of tools of the previously discussed type.

The pressures to be exerted on the working members, i.e., the tightening ability in the case of pincers, are always great and the hydraulic jack must develop relatively high pressures, on the order of 700 bars and often more.

In almost all cases, the work to be accomplished by means of the tool is a repetitive process which must be effected in a rapid cadence for economic reasons. It is therefore, necessary to reduce, as much as possible, the number of piston thrusts of the pump, required for the total advancement of the piston. For a determined total advancement this number is proportional to the relation $D^2/d^2$ in which D is the diameter of the piston of the jack and d is that of the piston of the pump. However, the force to be exerted by the operator, which should not exceed 100 newtons approximately since the tool must be capable of being handled with one hand, is proportional to the reverse relation $d^2/D^2$. Of course, the effort required from the operator is also inversely proportional to the arm of the lever of the pump, but there again, one must bear in mind a contrary obligation. The course of the end of the manipulation handle is limited due to the need for manipulation with one hand, for example of approximately 80 millimeters and the arm of the lever cannot be increased except by reducing the stroke of the piston of the pump, whereas the number of thrusts of the piston is clearly inversely proportional to this course.

Until now, with the exception of the particular dispositions adapted to reduce the range of advancement to be carried out by an hydraulic process, i.e., a rapid mechanical approach of the jaws of the pincer, with locking, before advancement under pressure, or other specific means, it was necessary to be satisfied with a compromise permitting acceptable values for each of the parameters (for example: manual effort 130N, number of thrusts of the pump 24, weight of the tool 1.5 kilograms), without allowing the whole to result in optimum conditions of performance and comfort.

SUMMARY OF THE INVENTION

In order to reconcile the contradictory principles mentioned earlier, the invention has as its goal a certain number of improvements to tools of the sort mentioned above relating to the structure of the jack, the disposition and the structure of the manipulation handle, and the fastening of the head carrying the working members on the end of the jack.

First of all, in order to reduce the number of thrusts of the pump which are required for the total advancement, the invention provides a staged piston for the jack to permit a range of advancement by means of a thrust of the pump which is relatively high at the beginning of the thrust, which decreases by successive stages, each decrease corresponding, however, to an increase in the total push by a same effort exerted on the lever of the pump. Although jacks with a staged piston are known, they are differential jacks, for example, as shown in French Pat. No. 2,242,584, which permit one to obtain a driving force which varies with the course, during the intake of a high pressure fluid. The problem to be resolved here is different in that the force applied on the parts to be worked is a function of the effort provided by the operator and cannot vary except with this effort when the values of d and D described above have been chosen. What one wishes to obtain by the choice of a piston with a staged jack is to use only one possible frontal surface portion of the piston, as long as the resistance to be overcome is weak, in order to have a maximum advancement with each discharge of a volume of fluid corresponding to that of the body of the pump.

An object of the present invention is to provide a tool having at least one mobile working member whose relative displacement with respect to at least one working member said to be fixed is linked to that of the piston of a hydraulic jack which is activated by a suction and discharge pump, which is noteworthy in that the piston is a staged piston which is nested in the body of the jack in such a manner to delimit, in addition to the main axial chamber, at least one annular chamber, the annular chamber or chambers being placed successively in communication with the axial chamber during the advancement of the piston.

In order to take full advantage of the flexibility resulting from the above-mentioned disposition, it is preferable that the range of advancement by thrusts of the pump, which is a function of the stroke of the piston of the jack, vary effectively by successive stages. Thus, it is necessary to eliminate or at least reduce as much as possible the interstitial leaks between the successive chambers, contrary to what occurs in the known differential jacks with a staged piston where the smoothing off of the variations is always permissible and intentional, for example, as disclosed in French Pat. No. 2,242,584.

To do this it is necessary that, even at the end of the stroke, each segment of the tier of the piston have at least one peripheral zone which remains in guiding contact with an interior surface of the body of the jack. Thus in this zone at least one joint ensures the sealing between the upstream and downstream chambers so that the supplying under pressure of each annular chamber is ensured by a radial line which opens up at one of its ends into the discharge line of the pump and whose other end is uncovered by the piston when advancement of the latter reaches a predetermined value, so that each chamber communicates with the fluid tank by a line with a valve which ensures the discharge of the relevant chamber by means of a manual control of the valve and the filling up of the relevant chamber by depression at the beginning for the annular chambers.

The disposition in tiers of the piston of the jack can be of interest to the lateral external surface of said piston cooperating with conjugated shoulders of the lateral internal surface of the body of the jack. It can also be made on the internal surface of an axial bore or chamber of the piston capping a shank longitudinally crossed by the discharge line of the pump and having conjugated shoulders.

As previously stated, use of a staged piston for the jack permits a considerably reduced effort to be exerted on the pump without thereby reducing either the final pressure exerted by the jack, or the speed of advancement of the piston upon starting. It is then possible to foresee activation of the pump by a cam lead by a light electric motor of sufficiently low strength to be supplied by battery or rechargeable incorporated batteries.

Another object of the present invention is to provide an hydraulic hand-tool having a particular structure and position of the hand-tool so as to manually control the pump. In this embodiment, the handle has two branches which are subjected to the action of the elastic means tending to distance them from each other in the way of those of a cutter, one being rigidly fixed on the body of the jack and presenting a transversal section in the shape of a U in which the mobile branch is encased, at least partially, in order to increase as much as possible the course of the latter, without increasing the maximum distancing of the ends of the two branches, while the bisecting line of the angle formed by said branches in the maximum distancing position is appreciably perpendicular to the longitudinal axis of the jack.

In all the cases, it is advantageous to provide a fastening for the head carrying the working members having a cut ring cooperating with a conjugated threading carried by the external surface of the nose of the body of the jack in such a manner to permit one to effect an initial displacement of the mobile working member independently from the hydraulic control. This disposition is particularly useful in the case of a repetitive process to be carried out on a series of objects or identical materials.

According to another aspect of the invention, a security valve may be provided to limit the pressure at the end of the stroke, whose sudden return produces a chattering constituting a sound signal and which, being manually controllable, at the same time plays the role of a valve for discharge of the main axial chamber. In this embodiment, therefore, it has been found to be advantageous to provide the discharge valves of the different chambers.

BRIEF DESCRIPTION OF DRAWINGS

Other objects and characteristics of the invention will will be readily understood upon reading the description which follows and upon examination of the annexed given by way of non-limiting examples to illustrate the embodiments of the invention shown in drawing, in which:

In FIGS. 1 and 2, a tool according to the invention is shown as including a hydraulic jack having a body 1 in which slides, in the direction of arrow $F_1$, under the action of the push of a fluid coming from fluid tank 3, while the return of the piston, when the hydraulic push stops, is assured by the action of a helicoidal spring 4 working on compression. The fluid is extracted from a fluid tank 3 and sent towards the piston, in a discharge line 5 by a suction and discharge pump whose piston 7 is activated by means of an oscillating arms 8 which is manually manipulated. In a known manner, the passage and retention of the fluid during suction, then discharge, are assured by two opposed antireturn valves 9*a* and 9*b*. In accordance with the present invention, arm 8 can be manipulated with one hand and to this effect is associated with a fixed arm 6, as shown in FIG. 1, from which it distances itself under the action. When the two arms, i.e., fixed arms 6 and oscillating arm 8, are grasped and squeezed by the hand of the operator, in a manner similar to two handles of a conventional pair of pliers or pincers, and to ensure discharge of fluid under pressure.

Figure 1:
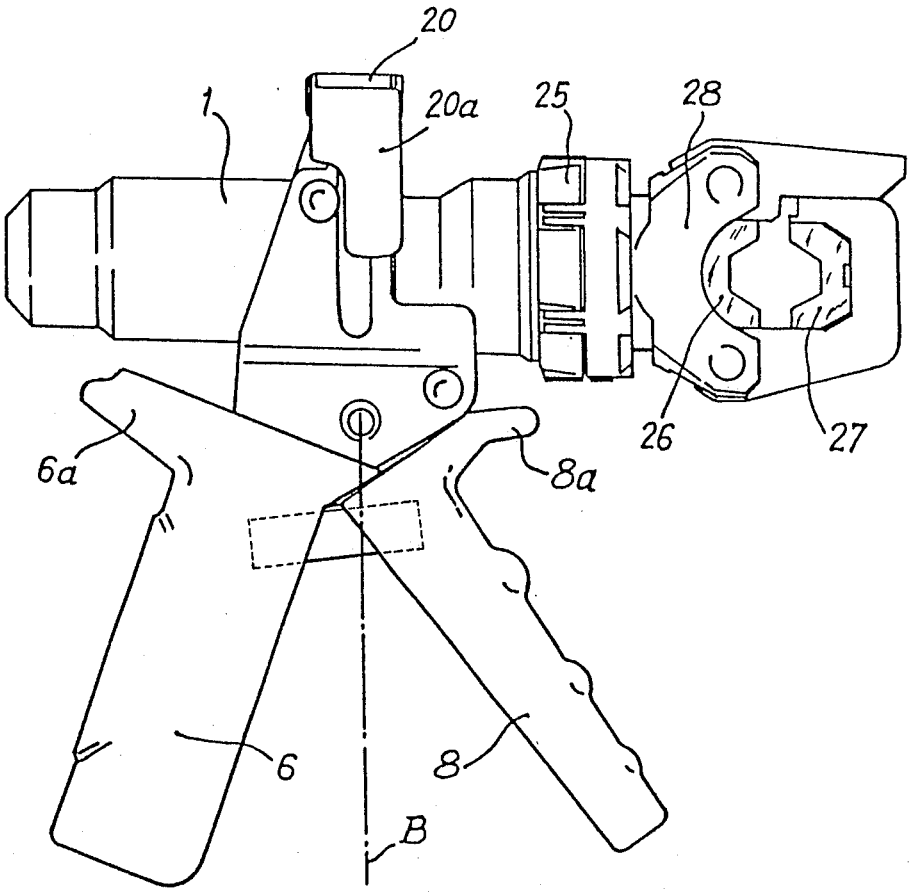
FIG. 1 is a view in profile of a tool according to the invention, here pincer for encasing.

Piston 2 has at its internal end, an axial bore or cavity 10 delimiting a connected handle or lateral surface assuring its guiding inside the cylinder 1, at the side opposite, to the head of the piston by a shoulder 12 forming one of the support surfaces of the spring 4.

The interior of cylinder 1 is machined in such a manner to have a conjugated bore or cavity in the particular form of the piston, with a central chamber 13 delimited by the bottom of the bore or cavity 10 and an annular chamber 14 delimited by the terminal surface of the handle 11 of the piston. Central chamber 13 is supplied by the discharge line 5 which opens up directly into said chamber. Annular chamber 14, first filled by depression as will be stated later, is then supplied by a radial line 16 leaving from the discharge line 5 and whose opening into chamber 14 remains blocked during the first part of the stroke of the piston. A certain number of toric joints and rings assure the sealing of the parts in movement and isolate the chambers 13 and 14 from one another as long as the opening of line 16 is not uncovered.

Figure 2:
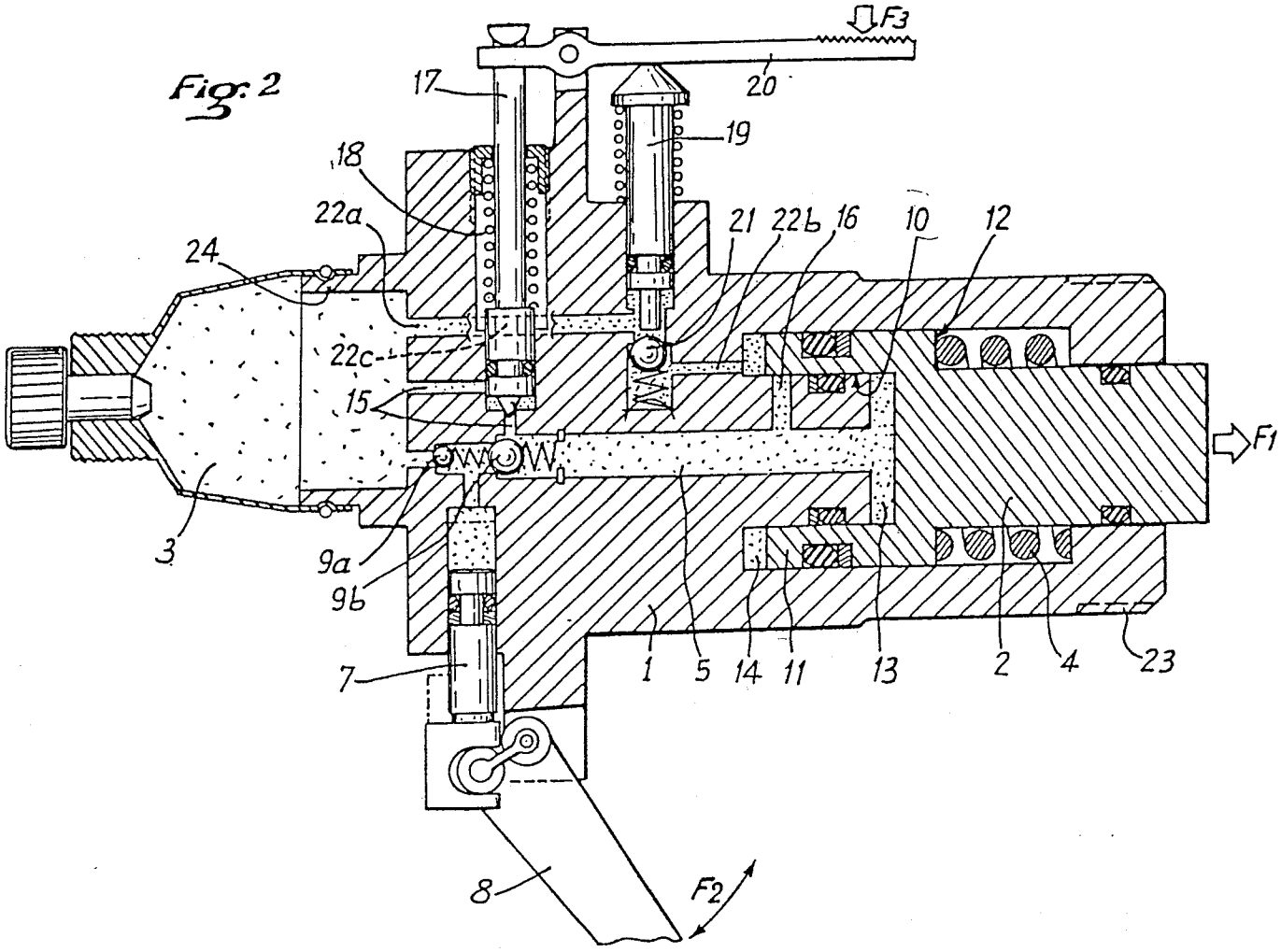
FIG. 2 is a longitudinal cross-section on a larger scale of a jack with two tiers equipping the tool in FIG. 1.

A discharge valve 17, retained on its seat by calibrated spring 18 is put on a line 15 placing discharge line 5 in communication with fluid tank 3. Valve 17 is raised from its seat to free the passage of fluid. This my be accomplished when the hydraulic pressure exceeds the calibration of spring 18, and in so doing functions as a safety device to avoid the deterioration of the cylinder. Alternatively, this may be accomplished by the action of a lever 20 manually manually manipulated as illustrated by arrow $F_3$, to obtain a retraction of the piston when working or at the end of the work. Of course the retraction of the piston also requires the emptying of the annular chamber 14. For this, a valve lifter 19 permits the hiding of a ball bearing valve 21 positioned between the two parts 22*a* and 22*b* of a line placing chamber 14 in communication with and fluid tank 3. Valve lifter 19 as well as valve 17 are controlled manually by lever 20. It should be noted here that for reasons of clarity, FIG. 2 is conventional. In reality, the longitudinal axis of valve 17 and of line 15 is not in the same diametrical plane as the axis of valve lifter 19, median portion 22*c* (indicated on the figure by broken lines) of line 22*a*, 22*b* not cutting the groove of valve 17. In fact, valve 17 and valve lifter 19 are angularly offset in a transversal plane with respect to the axis of the jack, lever 20 itself extending transversely with respect to this axis and having an end 20*a* lowered at 90 degrees, as shown in FIG. 1, to be manipulated by the thumb of the operator.

The filling of chamber 14 from fluid tank 3 is initially carried out using lines 22*a*, 22*b*, 22*c*. In so doing, valve 21 is distanced from its seat by the depression provoked by the advancement of the piston.

The functioning of the jack is clear. Each thrust of the pump brings into chamber 13 a volume of fluid determined by the diameter and the stroke of piston 7 of the pump, for example 170 $mm^3$. During the first part of the course, only the chamber 13 is active and if the bottom of the bore or cavity 10 is, for example, of 283 $mm^2$ (diameter 19 mm), each thrust of the pump will cause the piston to advance by 0.6 mm. As soon as the opening of the line 16 is freed, the volume of liquid brought with each thrust of the pump is distributed between the chambers 13 and 14, that is to say on a larger total surface, for example 2½ times the first, and the advancement by thrust will only be of 0.24 mm. At the same time, however, the same manual effort will permit one to exert pressure which is 2½ times greater. It is thus possible to achieve pressures in the area of 25,000N using very few thrusts, for example 20, as long as the total advancement remains weak (between 5 and 7 mm approximately) which is the case for pincers and similar devices. At the end of the process the interior pressure continues to increase until valve 17 is raised against spring 18, before falling down suddenly on its seat causing one to hear a chattering sound which constitutes a sound signal indicating that it is necessary to recall the piston by activating lever 20.

The end of cylinder 1 corresponding to the outlet of piston 2 can be equipped with an exterior threading 23 adapted to receive, for example by screwing, a fastening ring 25 for a head 28 of interchangeable tool. This disposition permits a single jack to be used for tools of the same sort but of different sizes and also for different types of tools, for example pincers for encasing, for boring, for cutting for bending, and the like. Moreover, by screwing or unscrewing of the ring 25, one can adjust the initial position of the mobile working member 26 and consequently the initial distancing of the working members 26 and 27 as a function of the dimensions of the object or the material to be treated.

In the example represented in FIG. 2 and according to known dispositions, fluid tank 3 is semirigid. In this regard, fluid tank 3 is somewhat retractable and expandable in such a manner to follow the variations of the volume of the liquid remaining in reserve without risk of air entry. Thus, fluid tank 3 may be installed in position merely by being inserted elastically on an appendix in the shape of a ring 24 of cylinder 1 on which it is maintained by an elastic ring cooperating with a circular groove.

It is clear that there can be several annular chambers 14 each corresponding, at the time of their placement in communication with the discharge line 5, to an increase in the total pressure exerted by the mobile tool and to a decrease in the advancement speed.

Figure 3:
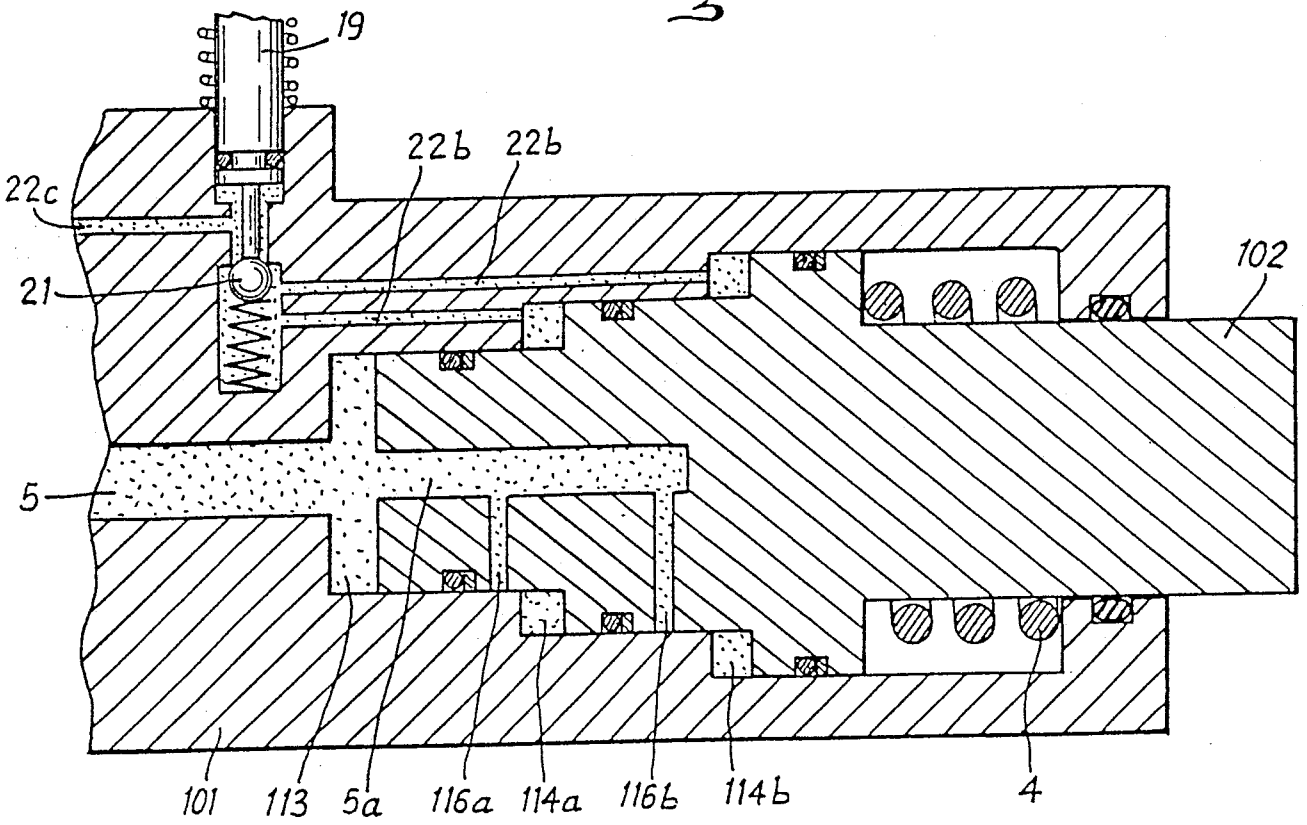
FIG. 3 is a simplified cross-section of a jack with three advancement speeds according to another embodiment, in which the encasing of the piston in the body is respectively male and female.

The disposition in tiers of the piston of the jack can also be carried out by encasing of the piston in the body with shoulders of the lateral external surface of the piston and conjugated shoulders of the lateral internal surface of the body of the jack. Such an embodiment with two annular chambers (three speeds for advancement) is represented very schematically in FIG. 3. In this figure, the same references as those in FIG. 2 have been kept to designate the identical elements, that is to say return spring 4 of the piston, discharge line 5, valve lifter 19 of valve 21 and line 22*c* forming pat of the communication between the bore or cavity of valve 21 and the fluid tank, not shown in this figure. The elements which are not identical to those in FIG. 2, but function in an equivalent manner, have than designated using similar references, increased by 100. In this regard, body 101, piston 102, main axial chamber 113, annular chambers 114*a* and 114*b*, are each delimited by an external shoulder of the interior end of piston 102 and an internal shoulder of the bottom of the cylinder, and their repective line for supplying under pressure 116*a* and 116*a*. Of course, each annular chamber communicates with the bore or cavity of valve 21 by a line 22*b* for filling up by depression and of discharge. Inasmuch as the annular chambers are positioned downstream from the axial chamber with respect to the direction of advancement of the piston, the discharge line 5 extends by a bore without outlet 5*a* placed axially in the piston 102 to supply lines 116*a* and 116*b*.

For reasons of comfort and effectiveness, handles 6 and 8, respectively fixed and mobile, may be provided with an insulating coating equipped with fingerprints and guards 6*a*, 8*a*. Moreover, so as to allow the forearm of the user to preserve a natural position, plan B, perpendicular to the longitudinal axis of the jack and passing through the journalled axis of the mobile handle 8, is adjacent to the bisecting plane of the handles 6 and 8 in the position of maximum distance. Finally, to permit an increase of the course of the mobile handle 8, always with the goal of reducing the number of thrusts of the pump required for the total advancement without increasing the initial distancing of the handles, the fixed handle 6 has a section in U-shape and the mobile handle 8 is at least partially set in this U.

As has been said earlier, the position in tiers of the piston permits the reduction in large proportions of the driving effort to be exerted on piston 7 of the pump. It is then possible to activate this piston with a cam or a connecting rod led by a light electric motor of sufficiently weak power to be supplied by accumulators or rechargeable incorporated batteries, for example, in the then fixed handle of the tool.

From the foregoing description, one skilled in the art can easily ascertain the essential characteristics of this invention and, without the departing from the spirit and scope thereof, make various changes and modifications of the invention to adapt it to various usages and conditions.

We claim:

1. An hydraulic hand-tool including an hydraulic jack capable of being operated manually using one hand comprising:

(a) an elongate piston having a front end adapted to be connected to a tool and at least two sections of different transverse cross-sectional areas having an exterior surface area;

(b) a housing including a hollow front end portion having an interior surface defining a plurality of sections with different inner diameters corresponding in size, position and number so as to accommodate said sections of said piston in a manner which permits said piston to slide in a reciprocating manner within said hollow front end portion of said housing whereby a plurality of chambers including a main chamber and at least one auxiliary chamber for receiving hydraulic fluid are defined by said exterior surface area and said interior surface as said piston slides in a forward direction;

(c) an hydraulic fluid supply conduit having a primary line with an end opening directly into said main chamber and at least one supplemental line having a port adapted to communicate with said at least one auxiliary chamber after said piston slides in a forward direction a predetermined distance to a position forward of said port;

(d) an hydraulic fluid reservoir adapted to supply hydraulic fluid to another end of said primary line;

(e) a pump in communication with said primary line adapted to transfer fluid from said reservoir through said primary line first into said main chamber to cause said piston to move in a forward direction for said predetermined distance and thereafter through said at least one supplemental line into said at least one of auxiliary chamber to cause said piston to continue to move in a forward direction, thereby successively placing said main chamber into fluid communication with said at least one auxiliary chamber while maintaining said main chamber separate from said auxiliary chamber as said piston moves in said forward direction; and (f) an hydraulic jack operably connected to said pump capable of being operated manually by one hand.

2. The hydraulic hand-tool in accordance with claim 1, wherein said at least one auxiliary chamber includes at least two annular chambers and said at least one supplemental line includes at least two supplemental lines, each of said at least two supplemental lines interconnecting said primary line with a respective one of said at least two annular chambers.

3. The hydraulic hand-tool in accordance with claim 1, wherein said at least one supplemental line extends radially from said primary line to said at least one auxiliary chamber.

4. The hydraulic hand-tool in accordance with claim 1, further comprising:

(f) a primary hydraulic fluid discharge conduit communicating between said at least one auxiliary chamber and said hydraulic fluid reservoir; and (g) a supplemental fluid discharge conduit communicating between said hydraulic fluid supply conduit and said hydraulic fluid reservoir.

5. The hydraulic hand-tool in accordance with claim 4, further comprising:

(h) a valve system positioned with respect to said primary hydraulic fluid discharge conduit and said supplemental hydraulic fluid discharge conduit so as to prevent passage of fluid from said at least one auxiliary chamber and said main chamber to said hydraulic fluid reservoir and being adapted to open said primary hydraulic fluid discharge conduit and said supplemental hydraulic fluid discharge conduit to permit said passage of fluid.

6. The hydraulic hand-tool in accordance with claim 5, wherein said valve system includes means for biasing means for blocking said primary hydraulic fluid discharge conduit and said supplemental hydraulic fluid discharge conduit into position so as to prevent said passage of fluid.

7. The hydraulic hand-tool in accordance with claim 6, wherein said means for biasing is loaded to exert a predetermined force on said means for blocking corresponding to a maximum predetermined pressure to be accumulated within said main chamber and said at least one auxiliary chamber whereby said means for blocking is adapted to open said primary hydraulic fluid discharge conduit and said supplemental fluid discharge conduit to permit said passage of fluid when said maximum pressure is exceeded.

8. The hydraulic hand-tool in accordance with claim 7, wherein said valve system further includes means for selectively opening said primary hydraulic fluid discharge conduit and said supplemental hydraulic fluid discharge conduit to said passage of fluid operably connected to said means for blocking.

9. The hydraulic hand-tool in accordance with claim 7, wherein said means for biasing is a spring.

10. The hydraulic hand-tool in accordance with claim 8, wherein said valve system includes means for sounding an alarm when said maximum pressure is exceeded.

11. The hydraulic hand-tool in accordance with claim 1, wherein said pump is a suction and discharge pump including a pump piston reciprocatably moveable within a chamber in communication with said primary line of said hydraulic fluid supply conduit.

12. The hydraulic hand-tool in accordance with claim 11, wherein said pump piston is operably connected to means for moving said piston within said chamber.

13. The hydraulic hand-tool in accordance with claim 12, wherein said means for moving includes two branches pivotally connected on a journal, said branches being adapted to be moved towards and away from each other.

14. The hydraulic hand-tool in accordance with claim 13, wherein one of said branches is fixed on said housing and another of said branches is moveable with respect to said one of said branches.

15. The hydraulic hand-tool in accordance with claim 14, wherein said means for moving further includes means for biasing said one and said another of said branches away from each other.

16. The hydraulic hand-tool in accordance with claim 15, wherein said one of said branches has a U-shaped transverse cross-section adapted to receive said another of said branches when said another of said branches is moved towards said one of said branches.

17. The hydraulic hand-tool in accordance with claim 15, wherein said one of said branches is fixed on said housing and said another of said branches is biased away from said one of said branches such that said one and said another of said branches are substantially equally spaced away from and form substantially the same angle with respect to a plane perpendicular to a longitudinal axis of said piston passing through a journal.

18. The hydraulic hand-tool in accordance with claim 1, further comprising:

(i) a means for performing work removeably attached to said hollow front end portion of said housing operably connected to said front end of said piston so as to be activated by movement of said piston.

19. An hydraulic hand-tool including an hydraulic jack capable of being operated manually using one hand comprising:

(a) an elongate piston having a front end adapted to be connected to a tool and at lest two sections of different transverse cross-sectional areas having an exterior surface area;

(b) a housing including a hollow front end portion having an interior surface defining a plurality of sections with different inner diameter corresponding in size, position and number so as to accommodate said sections of said piston in a manner which permits said piston to slide in a reciprocating manner within said hollow front end portion of said housing whereby a plurality of chambers including a main chamber and at least one auxiliary chamber for receiving hydraulic fluid are defined by said exterior surface area and said interior surface as said piston slides in a forward direction;

(c) an hydraulic fluid supply conduit having a primary line with an end opening directly into said main chamber and at least one supplemental line having a port adapted to communicate with said at least one auxiliary chamber after said piston slides in a forward direction a predetermined distance to a position forward of said port;

(d) an hydraulic fluid reservoir adapted to supply hydraulic fluid to another end of said primary line;

(e) a pump in communication with said primary line adapted to transfer fluid from said reservoir through said primary line first into said main chamber to cause said piston to move in a forward direction for said predetermined distance and thereafter through said at least one supplemental line into said at least one of auxiliary chamber to cause said piston to continue to move in a forward direction, thereby successively placing said main chamber into fluid communication with said at least one auxiliary chamber as said piston moves in said forward direction; and (f) an hydraulic jack operably connected to said pump capable of being operated manually by one hand, wherein at least one section of said piston has an exterior surface adapted to maintain continuous contact with at least one section of said interior surface of said hollow front end portion of said housing as said piston slides in a forward direction, and wherein at least one section of said piston is provided with a seal adapted to engage a corresponding section of said inner surface of said hollow front end portion of said housing so as to prevent passage of fluid between said chambers.

* * * * *